United States Patent [19]

Hmelovsky et al.

[11] Patent Number: 4,707,791

[45] Date of Patent: Nov. 17, 1987

[54] ON-BOARD MOTOR VEHICLE TIMING MEASUREMENT SYSTEM

[75] Inventors: Michael W. Hmelovsky, Windsor; Rinaldo R. Tedeschi, Newington, both of Conn.

[73] Assignee: United Technologies Corporation, Hartford, Conn.

[21] Appl. No.: 697,597

[22] Filed: Feb. 1, 1985

[51] Int. Cl.[4] ..... F02P 5/04

[52] U.S. Cl. ..... 364/431.04; 364/569; 123/416; 123/414

[58] Field of Search ..... 364/431.03, 431.04, 364/569; 123/414, 416, 417

[56] References Cited

U.S. PATENT DOCUMENTS

| | | | |
|---|---|---|---|
| 4,018,197 | 4/1977 | Salway | 364/431.04 |
| 4,165,459 | 8/1979 | Curtice | 364/569 |
| 4,181,884 | 1/1980 | Shirasaki et al. | 123/414 |
| 4,210,111 | 7/1980 | Hattori et al. | 123/414 |
| 4,225,925 | 9/1980 | Hattori et al. | 364/569 |
| 4,273,089 | 6/1981 | Maier | 123/416 |
| 4,355,613 | 10/1982 | Rode et al. | 123/417 |
| 4,552,110 | 11/1985 | Yoshida et al. | 123/416 |
| 4,575,809 | 3/1986 | Sinniger et al. | 123/416 |

*Primary Examiner*—Parshotam S. Lall

*Attorney, Agent, or Firm*—Dominic J. Chiantera

[57] ABSTRACT

Engine timing measurement apparatus receives the engine gear tooth signal, sensed combustion, and a crankshaft index (CI) of top dead center (TDC). The apparatus includes a whole tooth interval counter for providing a whole number count of each complete tooth interval, and partial tooth counters for counting incomplete tooth intervals as the ratio of clock pulses counted in a present incomplete tooth interval divided by clock pulses counted in a preceding complete tooth interval, the partial count added to the whole count to provide a decimal value indicative of engine timing.

2 Claims, 4 Drawing Figures

ON-BOARD MOTOR VEHICLE TIMING MEASUREMENT SYSTEM

TECHNICAL FIELD

This invention relates to internal combustion (IC) engines, and more particularly to the measurement of IC engine timing.

BACKGROUND ART

The use of electronics in controlling IC engine operation is well known. This includes electronic engine control (EEC) equipment for controlling engine fuel injection, fuel density compensation, cold start etc., and vehicle mounted diagnostic equipment which monitor and record engine operating parameters to provide a vehicle maintenance data base, or for feedback of engine performance to the EEC.

One such operating parameter is engine timing, defined as the crankshaft angle interval between a cylinder's full combustion point and its piston's top dead center (TDC) position. The crankshaft angle is measured by monitoring rotation of the engine's ring gear mounted on the flywheel assembly. The ring gear is provided with gear teeth by the engine manufacturer to allow the flywheel to be engaged and driven by the starter motor during engine start-up. By monitoring ring gear rotation with a proximity sensor a series of signal pulses are obtained, each coincident with rotation of a gear tooth past the sensor position. The spacing between signal pulses is crankshaft angle.

The sensed crankshaft angle resolution is limited by the number ($T_c$) of ring gear teeth; the resolution defined as $360°/T_c$. The number of teeth on the ring gear varies; by engine model, and manufacturer. It may range from 92 to 152 teeth, corresponding to sensed crankshaft angle intervals of from 3.913° to 2.368°.

DISCLOSURE OF INVENTION

The object of the present invention is to provide apparatus for measuring engine timing with a resolution accuracy better than that achievable in the prior art.

According to the present invention, engine timing measurement apparatus receives the sensed ring gear tooth signal, a sensed combustion signal from a selected engine cylinder, and a crankshaft index (CI) signal indicative of the cylinder's top dead center (TDC) position. The apparatus includes a whole tooth interval counter for providing a whole number count of each complete tooth interval, and first and second partial tooth counters for providing fractional number counts of a present incomplete tooth interval, the fractional count provided as the ratio of clock pulses counted by one partial tooth counter in a present incomplete tooth interval divided by the clock pulses counted in a preceding complete tooth interval by the other partial tooth counter. The whole number count is summed with the fractional number count to provide a decimal value, wherein engine timing is represented by the ratio of the decimal value to the total ring gear tooth count, multiplied by 360°.

The apparatus of the present invention provides sensed engine timing with resolution accuracies better than (less than) 0.1° of crankshaft revolution. This represents multiple orders of magnitude improvement over the prior art resolution accuracy. It provides quantitative measurement of engine timing to an accuracy sufficient for engine control requirements.

The present invention may be used to measure engine timing on either a spark ignition or compression ignition (diesel) internal combustion (IC) engine. For spark ignition engines the sensed cylinder event may be spark plug firing. For diesel engines the sensed cylinder event may be start of combustion (SOC) or the opening of the cylinder's fuel injector.

These and other objects, features, and advantages of the present invention will become more apparent in light of the following detailed description of a best mode embodiment thereof, as illustrated in the accompanying drawing.

BRIEF DESCRIPTION OF THE DRAWINGS(S)

BEST MODE FOR CARRYING OUT THE INVENTION

Figure 1:
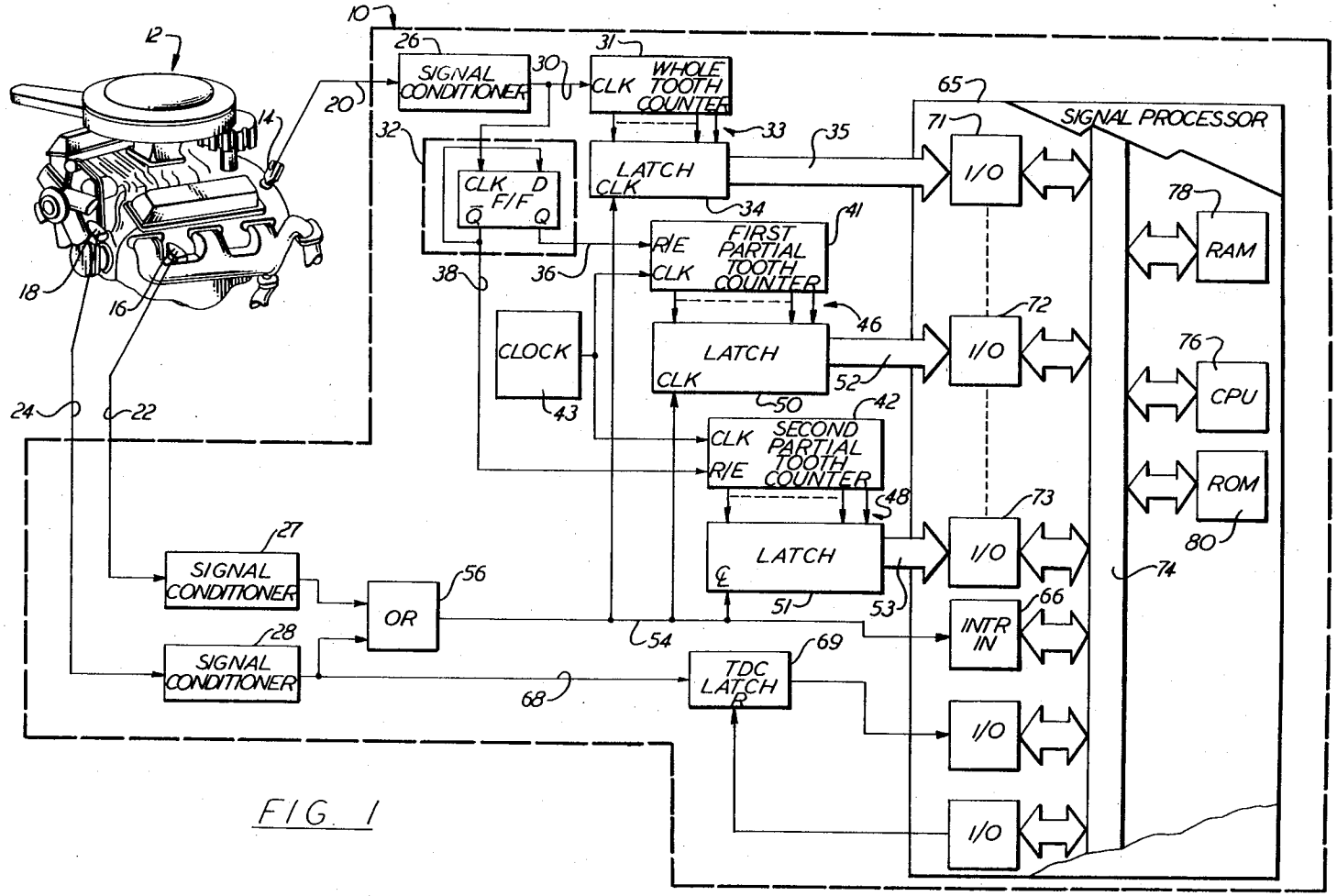
FIG. 1 is a system block diagram of a best mode embodiment of the present invention.

FIG. 1 is a system block diagram of the present apparatus 10 for automatically measuring timing of an instrumented, internal combustion engine 12. The engine may be diesel or spark ignition. The engine mounted instrumentation, includes a ring gear tooth signal sensor 14, a cylinder combustion event (i.e. engine event) sensor 16, and a crankshaft index (CI) sensor 18. The gear tooth sensor may be a known type proximity sensor, such as the Electro Corp. RGT Model 3010-AN, mounted on the engine housing in proximity to the ring gear to provide series pulse tooth signal on line 20.

For a diesel engine the sensed combustion event may be sensed by a start of combustion (SOC) sensor; any one of a number of SOC sensors known in the art may be used. Alternatively, the change in fuel line pressure to the cylinder's injector may be monitored using an in-line piezoelectric pressure sensor or a "needle lift" hall type sensor. In a spark ignition engine a spark plug firing sensor may be used, such as a Hall effect sensor which senses the No. 1 cylinder spark, all of which is well known in the art. The combustion sensor provides a signal pulse on line 22 coincident with occurrence of combustion in the cylinder.

The CI sensor is also a known type magnetic pickup sensor, such as the Electro Corp. Model 4947 proximity switch. The CI sensor is mounted in the engine damper housing to sense passage of the damper's timing marker notch. The sensor mounting position may be in phase (coincident) with the engine's actual TDC position so that the sensed notch passage coincides with true TDC, or displaced by a known crankshaft angle to provide a sensed TDC which is offset from true TDC. The sensed TDC signal is provided on line 24.

Figure 2:
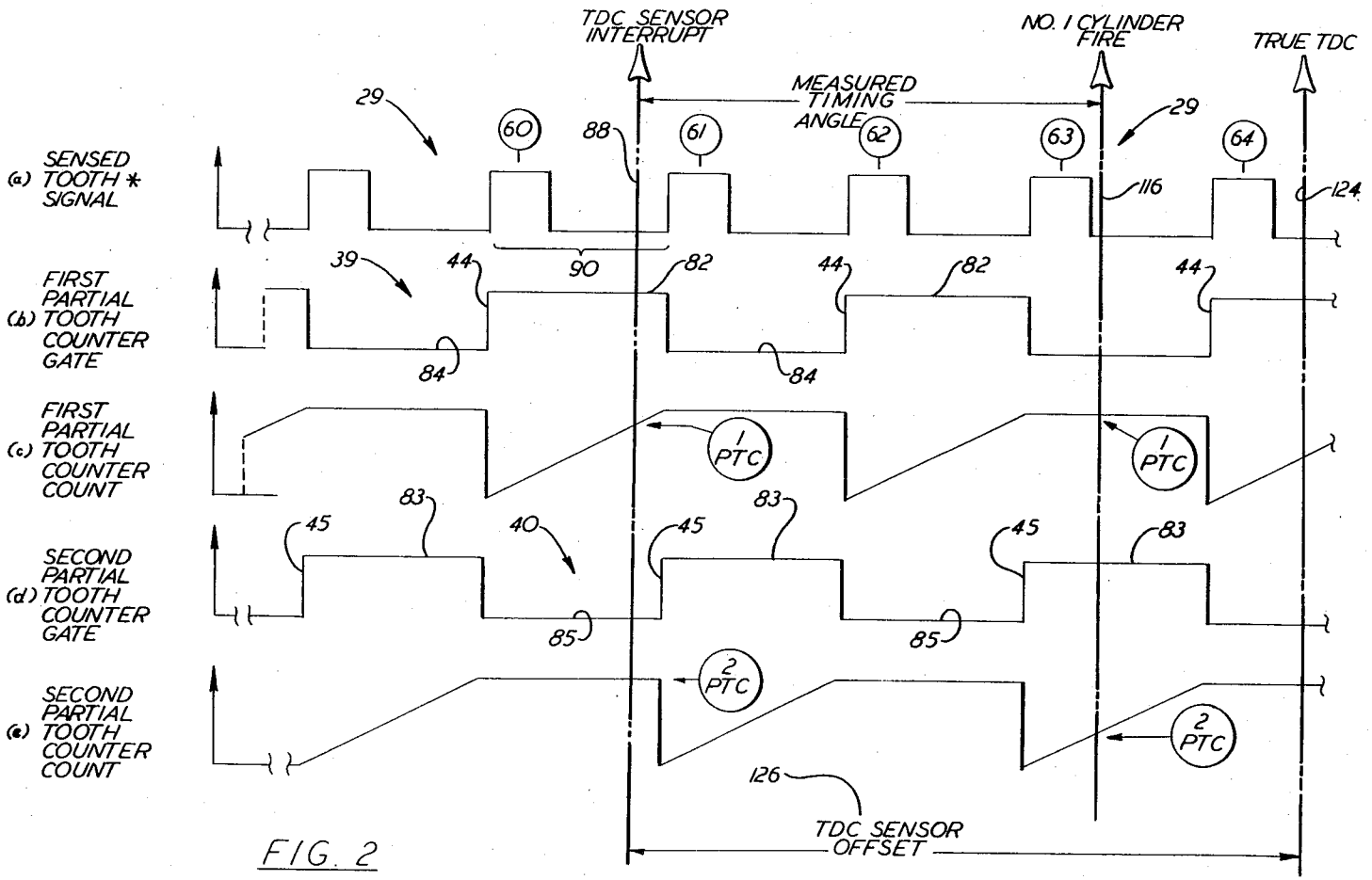
FIG. 2 is an illustration of a set of waveforms used in the description of the embodiment of FIG. 1.

The sensed parameter signals are conditioned by apparatus signal conditioners 26–28. The signal conditioner 26 provides a conditioned sensed tooth signal waveform 29, (FIG. 2, illustration (a)) on line 30 to the clock (CLK) inputs of a "whole tooth interval counter" 31, and a "divide by two" circuit 32. The counter 31 counts each whole tooth interval. It is preferably an up counter having a modulo equal to the number of ring gear teeth (e.g. 92–152). The counter is free running. The free running count is presented on lines 33 to latching register 34, which latches the count value appearing at the leading edge of a strobe received at the latch CLK input. The latched count is provided on output lines 35.

The divide by two circuitry may comprise a D, edge triggered flip/flop (F/F) which provides complementary Q and $\overline{Q}$ gate signal outputs on lines 36, 38. The gate signals, as shown by waveforms 39, 40 of FIG. 2, illustrations (b), (d), each have half cycles equal to the whole tooth interval (FIG. 2(*a*), and are 180 degrees out of phase. The gate signals are presented to the Reset-/Enable (R/E) input of first and second "partial tooth interval counters" 41, 42, to alternately enable, latch, and reset the counters on succeeding high and low logic states. Typically logic one enables, logic zero latches, and the zero to one transition resets the counters. As a result, the counters are enabled in alternate tooth intervals and the count obtained during the enabled interval is latched for the duration of the succeeding tooth interval. There is always a latched count value for a preceding completed tooth interval in one counter, and an ongoing count for a present incomplete tooth interval in the other counter.

Figure 3:
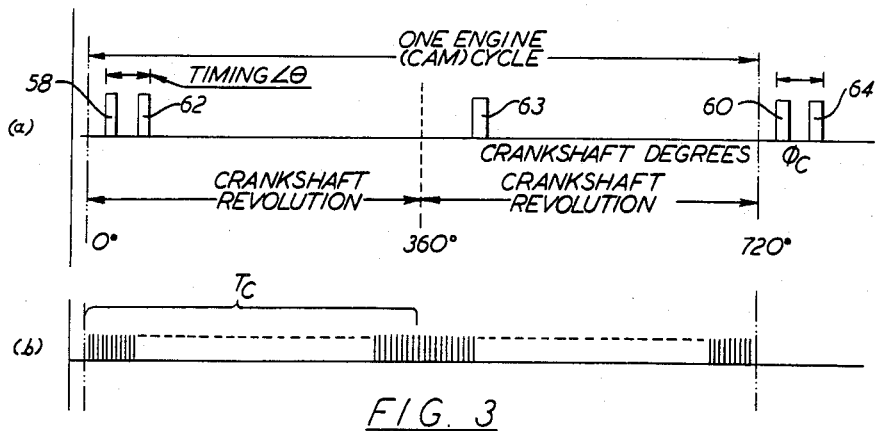
FIG. 3 is an illustration of another set of waveforms used in the description of the embodiment of FIG. 1.

The counters 41, 42 are free running modulo up counters which count clock pulses received at a CLK input from a system clock 43 during the enabled tooth interval. The count is latched during disable and reset to zero on the leading edge (logic 0 to logic 1 transition) e.g. 44, 45 of FIG. 2, illustrations (b), (d). The counter modulus is determined by: the minimum allowable engine RPM, the number of ring gear teeth, and the clock frequency, which define the maximum expected tooth interval count. Each counter output is presented through lines 46, 48 to associated latching registers 50, 52. Registers 34, 50, and 52 each receive a READ strobe signal on line 54 from OR gate 56, as either the No. 1 cylinder combustion signal or the CT TDC signal from signal conditioners 27, 28. For a four cycle engine, the No. 1 cylinder signal occurs once per 720° of crankshaft rotation (one engine cycle); the TDC signal occurs every 360° of crankshaft rotation, or twice per engine cycle. In FIG. 3, signal pulses 58, 60 represent No. 1 cylinder firing in successive engine cycles, or every 720 crankshaft degrees. Signal pulses 62–64 represent the occurrence of TDC every 360° of crankshaft travel. The TDC and No. 1 signal pulse, rising edge latches the count value in register.

A signal processor 65 receives the line 54 READ strobe at an interrupt input 66 and CI TDC signal at an input output (I/O) 67. The TDC signal from conditioner 28 is provided through line 68 to a TDC latch 69. The latch captures the TDC for the processor sample interval, after which it is reset by the processor through an I/O 70. The purpose of the separate TDC input is to allow the processor to distinguish between the engine event and TDC for the purpose of calculating the timing angle, as described hereinafter with respect to FIG. 4.

The signal processor is of a known type, preferably an eight bit processor, such as a Z80, an 8080, or preferably an NEC 7810. The signal processor may be a shared use processor which is resident in an onboard data acquisition unit, or an electronic engine control (EEC) (neither of which are shown here) since timing signal measurement is a low duty cycle task which may be time shared with other data acquisition or EEC operations.

The processor includes input/output (I/O) interfaces 71–73, responsive to the latched count on register output lines 35, 52, 53. The I/O's are connected through the control/data/address bus 74 to the processor central processing unit (CPU) 76, a random access memory (RAM) 78 and read only memory (ROM) 80. The processor, the processor operating system, and the system software, may be any of a number of different types which are known to those skilled in the art, and which are deemed suitable for the particular application.

In the operation of the apparatus 10, the ring gear tooth signals on line 30 (waveform 29, FIG. 2, illustration (a)) are counted by the counter 31 and divided by two to provide the complementary, essentially symmetrical Q, $\overline{Q}$ gate signals on lines 36, 38 (39, 40 in FIG. 2, illustrations (b), (d)). The gate signals, with equal high and low states, simultaneously, in each tooth interval, enable one partial tooth counter and latch the other. This allows for calculation of a quantitative value for each incomplete tooth interval as the ratio of the presently enabled counter count value divided by the count value for the immediately preceding tooth interval as stored in the presently latched counter. The resuolution of the partial tooth interval value is directly dependent on the frequency of the clock (43, FIG. 1). The higher the clock frequency the higher the partial tooth interval value resolution.

In FIG. 2, illustrations (c) and (e) represent the count value of the partial tooth counters (41, 42, FIG. 1) as a function of time and sensed tooth signal (illustration (a). Each is shown in analog fashion in conjunction with the tooth interval signal on line 30 and the engine event interrupt signals on line 54.

In the operation of the apparatus 10, as illustrated in FIG. 2, a TDC sensor interrupt 88 is coupled from line 24 to the CLK input of the three latches (34, 50, 51) causing the latches to capture the present count value in each of the three registers. In FIG. 2, illustration (a) the TDC sensor interrupt is shown to occur in a tooth interval 90. For purposes of explanation only, the tooth signal pulses of waveform 29 are numbered (e.g. 60, 61, 62, etc. out of an assumed modulo 120 for a 120 tooth ring gear) as the instant whole tooth count value for counter 31. Each leading edge of the sensed tooth signal increments the whole tooth counter by one.

In the present example, the latched whole tooth count in register 34 is equal to sixty. The partial tooth counts in the first and second partial tooth counters, are sampled as shown in FIGS. 2 (*c*) and (*e*) with the designators "1 PTC" and "2 PTC", respectively. In the example it is assumed that: (i) the engine speed is 600 RPM (3600 degrees/second), (ii) there are 120 ring gear teeth (3° of crankshaft per tooth), and (iii) the clock is 600 KHz.

With zero acceleration, the tooth signal period (t) is approximately 833.33 microseconds. The clock period ($t_c$) is 1.67 microseconds, so that a full tooth interval count is on the order of 500. At the assumed CI sensor TDC interrupt (88, FIG. 2) the 1 PTC count value is approximately 5/6ths of the full tooth interval count, or 417. The value of 2 PTC is 500. The ratio of 1 PTC divided by 2 PTC gives the partial tooth interval decimal value of 0.833, which is added to the whole tooth count value of 60 to provide a TDC sensor interrupt tooth count $T_N = 60.833$.

Figure 4:
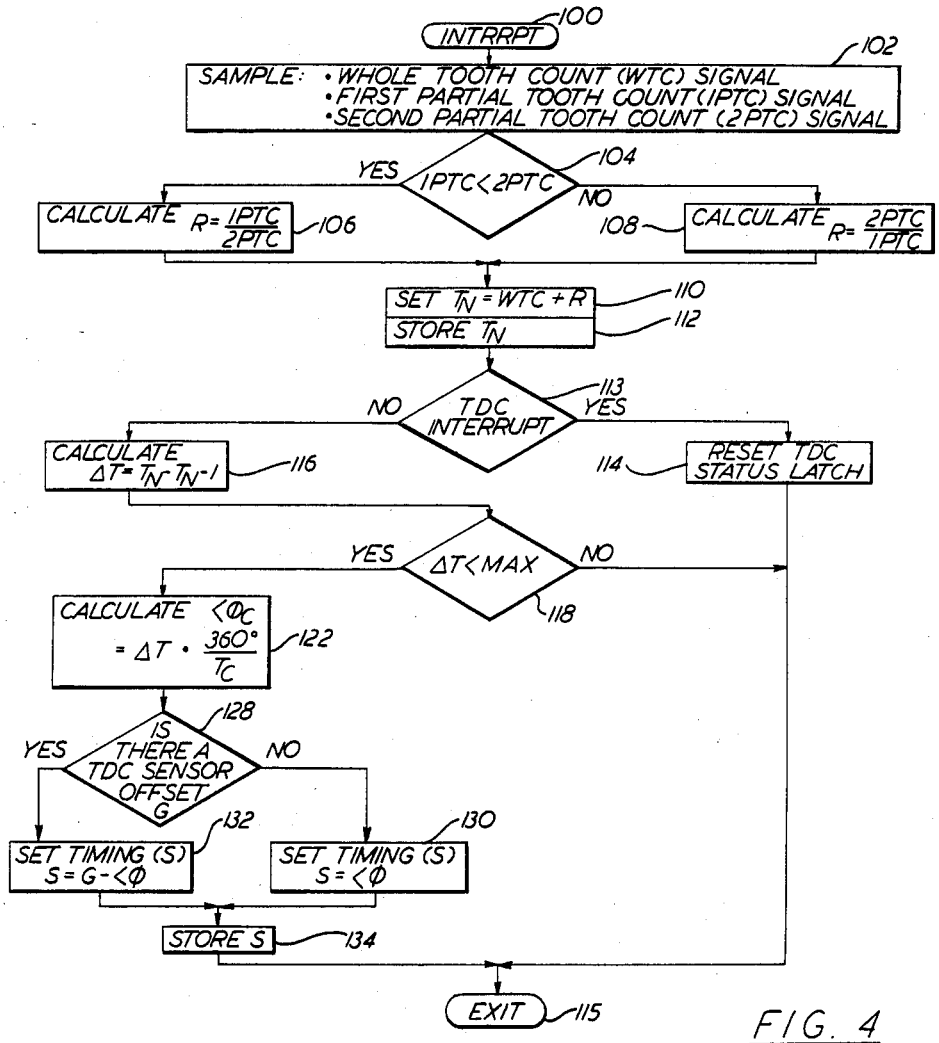
FIG. 4 is a flowchart diagram illustrating the operating steps performed by the FIG. 1 embodiment.

FIG. 4 is a flowchart illustrating the signal processor steps in calculating engine timing. The line 54 READ strobe interrupts the processor at 100 and instructions 102 require sampling of the latched counts in each of the three latches; the whole tooth count (WTC=60) and the partial tooth counts 1 PTC=417 and 2 PTC=500 for the example of FIG. 2. Decision 104 determines if 1 PTC is less than 2 PTC. This determines which of the two count values will be the numerator in the ratio calculation. Instructions 106, 108 perform the alternate ratios (R) depending upon the magnitude of the partial tooth count values. The ratio R establishes the decimal value for the partial tooth interval. Instructions 110 set the total tooth count for the present interrupt ($T_N$) as the sum of the whole tooth count plus the ratio decimal value, or $T_N = WTC + R$. Instructions 112 store the tooth count value.

Decision 113 determines if the received interrupt is a TDC signal. This allows the signal processor to distinguish between the TDC and engine event interrupts. If the answer is YES, the processor does not have to calculate the timing angle, and instructions 114 reset the TDC latch (FIG. 1). The processor exits the routine at 115.

Instructions 102–113 are repeated on each interrupt. The processor samples each of the three latched count values. Assuming the next interrupt in FIG. 2 is the No. 1 cylinder firing 116, the sampled WTC=63, the 1 PTC is 500, and the 2 PTC is 183. The ratio R=0.366 and the total tooth count $T_N$=63.366. The answer to decision 113 is NO, and the processor next executes instructions 116 to determine the difference, or net tooth count value ΔT. In FIG. 4 this is shown as the difference value between the present tooth count $T_N$ and the preceding tooth count $T_N-1$. For the present example this is equal to 63.366−60.833, or 2.533.

Decision 118 determines if the calculated net value is less than a selected maximum net tooth count value. This further distinguishes between the interrupts created by sequential TDC signals and those consisting of a TDC and a later No. 1 cylinder ignition, as occurs once per engine cycle. It helps in further reducing erroneous timing angle indications by eliminating crankshaft intervals which exceed the worst case maximum timing value. The maximum net value is selected based on particular engine model and ring gear tooth count. If the answer is NO the signal processor exits the routine at 115. If YES instructions 122 calculate the crankshaft angle interval $\angle\phi = \Delta T \cdot 360° / T_C$; where $T_C$ is the ring gear tooth count. In this example the scale factor is 3° per tooth and the calculated net tooth count of 2.533 is equal to a crankshaft angle of 7.6°.

In some applications it may be desirable to offset the sensed TDC sensor signal from the true TDC position. This arises when the true TDC occurs close to, or coincident with, the No. 1 cylinder firing. By offsetting the sensed TDC value by a selected "TDC sensor offset" the interrupt may be moved far enough away from the No. 1 cylinder firing to allow accurate calculation of the measured angle, after which the measured angle is subtracted from the TDC sensor offset angle value to determine the true engine timing value. This is illustrated in FIG. 2 with an assumed "true TDC" interrupt occurring at 124, which is displaced from the TDC sensor interrupt 88 by the illustrated TDC sensor offset interval 126. It should be understood, however, that this is discretionary with the user, and is not a limitation on the present timing measurement method.

In FIG. 4 decision 128 determines if there is a present TDC sensor offset value. If No, instructions 130 set the timing $S = \angle\phi$; the measured crankshaft angle value. If YES instructions 132 set the timing $S = G - \angle\phi$; the difference value between the offset (G) and the measured angle.

In the example it is assumed that there is no offset, such that the TDC sensor interrupt 88 represents the true TDC, such that S=7.6°. Instructions 134 store the timinig value in RAM 78, (FIG. 1) and the processor exits the routine at 115.

The above analysis assumes zero engine acceleration. In the present invention, however, the effect of engine acceleration on timing measurement accuracy is insignificant. A comparison of a zero acceleration and a 2000 RPM/sec acceleration timing measurement condition is shown in th Appendix hereto.

Although the invention has been shown and described with respect to a best mode embodiment thereof, it should be understood by those skilled in the art that various other changes, omissions, and additions may be made therein without departing from the spirit and scope of the invention.

APPENDIX

Accuracy of timing measurement during engine acceleration

For:

(i) engine velocity (v)=600 rpm=3600 deg/sec (ii) engine acceleration (a)=2000 rpm/sec=12000 deg/sec$^2$, and (iii) ring gear teeth=120; crankshaft interval between teeth, S=3 deg/tooth.

Consecutive tooth intervals $$\overset{3°}{|\leftarrow T \rightarrow|}\overset{3°}{\leftarrow T \pm \Delta t \rightarrow|}$$

show that the Δt caused by acceleration produces an insignificant error compared to the zero acceleration state.

For zero acceleration $$S = vT$$

for v=600 RPM, $$T = S/v = \frac{3 \text{ deg/tooth}}{3600 \text{ deg/sec}} = 833.3333\ \mu\text{sec.}$$

For acceleration of 2000 RPM/sec $S = vT + \frac{1}{2}aT^2$ solve for time for 3° of engine rotation.

$$3° = 3600°/\text{sec} \times T + \tfrac{1}{2}(12000 \text{ deg/sec}^2)T^2$$

$$0 = 2000 \text{ deg/sec}^2 \times T^2 + 1200 \text{ deg/sec} \times T - 1\text{deg}$$

$$0 = 2000/\text{sec}^2 T^2 + 1200/\text{sec} \times T - 1$$

solve using quadratic formula $$\frac{-b+\sqrt{b^2-4ac}}{2a}=\frac{-1200+1203.3287}{4000}$$

can only use positive time , T=832.1791 μsec solving for $$\Delta t=833.3333\ \mu sec-832.1791\ \mu sec$$

$$\Delta t=1.1542\ \mu sec.$$

Therefore, the time error between adjacent teeth is 1.1542 μsec

For a 600 KHz clock the counter is incremented once every 1/600 K sec=1.667 μsec. At this speed, it is possible to be off 1 count which represents a timing error of:

$$600\ rpm\times\frac{1\ min}{60\ sec}\times\frac{360\ deg}{1\ rev}\times\frac{sec}{600000}=.006\ deg$$

At the higher RPMs (ie 6000 RPM), the timing error is reduced

| | |
|---|---|
| $S = VT$ | $S = VT + \frac{1}{2}aT^2$ |
| $3° = 6000\ RPM \times t$ | $3° = 6000\ RPM \times T + \frac{1}{2}(2000\ RPM/sec)T^2$ |
| $T = 83.3333\ \mu sec$ | $T = 55.5550\ \mu sec$ |
| $\Delta t = 83.3333\ \mu sec - 83.3320\ \mu sec$ | |
| $\Delta t = 0.0013\ \mu sec$ | |

For this Δt change there is little chance of an extra count will be incremented in the timer. In fact, at this speed (6000 rpm) the error (actual) due to this time shift is approximately $$6000\ RPM\times 0.0013\ \mu sec=0.000047\ degree$$

For the above error numbers, it should be noted, that machining of the parts (flywheel) are rarely done to those accuracies.

What is claimed is:

1. Apparatus for measuring the timing angle of an internal combustion (IC) engine having a crankshaft mounted ring gear with a plurality of ring gear teeth spaced at substantially equal circumferential intervals, a top dead center (TDC) timing marker, and ignition apparatus, in a system having engine mounted sensors for providing engine sensed signals in each engine cycle, including: a ring gear signal having a series of tooth pulses marking the tooth intervals between passage of successive ring gear teeth past a fixed point in the engine, a TDC signal indicative of the occurrence of TDC in a selected engine cylinder, and an ignition signal indicative of the occurrence of combustion in the selected engine cylinder, the apparatus comprising:

timing means, for providing a series of clock pulses;

first counter means, for counting the number of ring gear signal tooth pulses occurring in each engine cycle, to provide a whole number tooth interval count signal indicative of the whole number of ring gear tooth intervals in each engine cycle;

first signal means, responsive to the pulsed ring gear signal, for providing oppositely polled, first and second bistable signals, each said bistable signal alternating between first and second signal states at each succeeding tooth interval of said ring gear signal, wherein said first and second bistable signals are in opposite ones of said first and second signal states at any time;

second and third counter means, each responsive to said timing means and to a related one of said first and second bistable signals, for accumulating the number of said clock pulses occurring in the presence of each said first signal state of the related bistable signal, said second and third counter means each storing therein for the duration of said next succeeding second signal state a sum clock count signal value obtained for each first signal state whereby one of said second and third counter means includes, at any time, a stored sum clock count signal value for an immediately preceeding tooth interval and another one thereof includes an accumulating clock count signal value for a present tooth interval;

signal processing means, having memory means for storing signals, and responsive to said engine sensed signal, for sampling said whole number tooth interval count signal value, said sum clock count signal value and said accumulating clock count signal value, to provide a sample value set, at the occurrence of TDC and at the occurrence of combustion in the selected cylinder in each engine cycle;

calculating a decimal number tooth interval value for each sample set as equal to the ratio of said accumulating clock count signal sampled value divided by said sum clock count signal sampled value and adding said calculated decimal number value to the sampled whole number tooth interval count signal to provide a total tooth interval signal for each sample set; and providing the difference value between said total tooth interval signals for each sample set as the engine timing signal.

2. The apparatus of claim 1, wherein said memory means includes stored crankshaft signals indicative of a crankshaft angle interval value associated with the tooth intervals of the ring gear signal, and wherein said processing means multiplies said difference value by said stored crankshaft signals to provide an angular value engine timing signal.

* * * * *